US006926000B2

(12) United States Patent
Yeung

(10) Patent No.: US 6,926,000 B2
(45) Date of Patent: Aug. 9, 2005

(54) RANGE HOOD MOTOR HOUSING AND FAN CONNECTOR

(76) Inventor: Peter Yeung, 4446 Frances Street, Burnaby, British Columbia (CA), V5C 2R4

( * ) Notice: Subject to any disclaimer, the term of this patent is extended or adjusted under 35 U.S.C. 154(b) by 0 days.

(21) Appl. No.: 10/754,494

(22) Filed: Jan. 12, 2004

(65) Prior Publication Data

US 2004/0139959 A1 Jul. 22, 2004

(30) Foreign Application Priority Data

Jan. 16, 2003 (CA) ..... 2416394

(51) Int. Cl.[7] ..... F24C 15/20
(52) U.S. Cl. ..... 126/299 D; 454/67
(58) Field of Search ..... 126/299 D, 299 R; 454/67

(56) References Cited

U.S. PATENT DOCUMENTS 3,732,802 A * 5/1973 Kristof ..... 126/299 D
5,228,428 A * 7/1993 Jang ..... 126/299 D
5,469,837 A 11/1995 Chiang et al.
5,537,988 A 7/1996 Lin
5,979,436 A * 11/1999 Chiang et al. ..... 126/299 D
6,050,258 A * 4/2000 Neitzel et al. ..... 126/299 R
6,719,622 B2 * 4/2004 Peng ..... 126/299 R

FOREIGN PATENT DOCUMENTS

GB 2302728 A * 1/1997 ..... F24C/15/20

* cited by examiner

*Primary Examiner*—Sara Clarke
(74) *Attorney, Agent, or Firm*—Paul Smith Intellectual Property Law; C. Larry Kyle

(57) ABSTRACT

A range hood having an improved grease collecting motor housing and improved fan and motor connection. Housing openings are defined by circular walls projecting vertically into the housing acting to collect grease within the housing. A flange depends radially outwardly from, and at an angle to, the circular wall. Air entering the housing via the fan deflects off the flange and prevents turbulent air within the housing from exiting the housing in the space located between the circular wall and the fan. The fan connection is comprised of a threaded recess in a shaft of the motor and a fan cap having a threaded bolt. The shaft is inserted through an aperture in the fan and the fan cap threadingly connected to it. A tray attachable to the housing, and defining an air intake opening has an improved mating relationship with a lower panel of the range hood.

9 Claims, 8 Drawing Sheets

RANGE HOOD MOTOR HOUSING AND FAN CONNECTOR

FIELD OF THE INVENTION

This invention relates to range hoods, and more particularly to an improved motor housing for use within a range hood and a connector for attaching a fan to the fan motor.

BACKGROUND OF THE INVENTION

Domestic range hoods having a pair of motors horizontally installed in a motor housing within the hood body are used above cooking surfaces to remove grease, common odors and hazardous gases created during the cooking process. A fan is connected to each of the motors. The fans suck air from the cooking area below and force it through the motor housing to ventilation piping.

Efforts have been made to produce a thinner range hood. Generally, the extent to which the size of the range hood can be reduced has been limited by the size of the motor housing within the range hood and the size of the grease tray connected below the housing. A prior art design for a range hood 10 is shown in FIG. 1. The motor housing 12 is divided into two substantially similar chambers and has a pair of circular walls 14 extending into the interior of the motor housing 12 (one for each chamber, only one of which is shown). The openings defined by walls 14 are dimensioned to allow the fans 16 to be removable from the motor housing interior.

The presence of the circular walls 14 prevents grease within the motor housing from draining back out through the opening. Instead, grease within the motor housing is directed to drainage hole located in the general area marked with reference numeral 18 where it travels to an external grease cup 20. Because most of the grease collects in and drains from the motor housing, very little grease collects in tray 22. Tray 22 acts mainly to control the airflow into the fan. While the combination of wall 14 and tray 22 does restrict most of the air drawn into fan 16 to that from outside of the range hood, some air from within the motor housing is able to pass from within the motor housing back to the fan as illustrated by arrow 24. This reduces the overall suction power and efficiency of the range hood.

In addition, as best shown in FIGS. 2 and 3, fan 16 is attached to motor 11 and secured in place by way of fan cap 26. The shaft 28 of the motor 11 fits within a channel 30 passing through the fan 16. The threaded portion 29 of shaft 28 extends below the channel 30 such that fan cap 26 may be screwed on. A torsional member 32 fits within a recess in the fan so that rotational force may be transferred from the motor 11 to the fan 16. However, because the shaft 28 and fan cap 26 extend below the level of the motor housing, the fan grill 34 must be conical in shape in order to allow sufficient space. As the vaporized grease contained in the entrained air passes by the fan grill 34 some of the grease condenses on the bars of the grill. Grease collecting on the grill drains along the bars of the grill to the lowest point until there is sufficient grease to form a drop. In order to prevent grease from dripping off the grill, an additional grill tray 36 is required. This must be removed and cleaned periodically and adds to the manufacturing costs.

It is therefore an object of an embodiment of the invention to provide a range hood that does not require a grill tray.

It is a further object of an embodiment of the present invention to provide a range hood, which has increased suction power over prior art range hoods of the same size.

It is a further object of an embodiment of the invention to provide a thinner range hood as compared to similar prior art range hoods.

Various aspects of the invention address these objects, but not all aspects of the invention necessarily address all such objects simultaneously. Other objects of the invention will be apparent from the description that follows.

SUMMARY OF THE INVENTION

The invention is directed to an improved motor housing for use within a range hood and a connector for attaching a fan to the fan motor.

In one aspect, the invention comprises a range hood for drawing air from below the range hood and venting it to another location comprising a motor housing, a motor, a fan, and a tray. The motor housing generally defines an enclosure and has an upper surface and a lower surface. The lower surface has at least one opening and at least one drain hole. The motor has a rotatable shaft with a torsional member and is mounted within the motor housing enclosure. The fan has a top fan surface and a bottom fan surface and a plurality of fan blades connected therebetween. The bottom fan surface has top and bottom edges and the fan is releasably connectable to the motor. The tray comprises an air intake opening, first and second tray walls extending around the intake opening, and a floor between the first and second tray walls. The tray is releasably connectable to the motor housing opening. The motor housing opening is defined by a wall depending from the lower surface and projecting into the interior of the enclosure, the wall having an angular flange depending from the wall radially outwardly from the motor housing opening.

In another aspect, a portion of the angular flange is located above the level of the top edge of the bottom fan surface such that when the fan draws air into the motor housing, a portion of air travelling immediately adjacent the bottom fan surface is deflected by the flange.

In a further aspect, the shaft has a threaded recess, the fan has an aperture through which the shaft may be inserted and a fan cap having a threaded bolt is threadingly engaged with the threaded recess of the shaft.

In yet another aspect a flat fan grill is connected to the first tray wall and when the fan is connected to the motor by the fan cap, the fan cap is above the level of a portion of the bottom fan surface.

In yet another aspect the motor housing is sized such that only a portion of the fan is located within the motor housing. The floor of the tray has a notch and a lowermost surface.

In yet another aspect the range hood has a range hood body having a releasably connectable lower panel. The lower panel has a bottom surface and an opening corresponding to the tray. When the lower surface is connected to the range hood body, the lower panel and the tray are in abutment and the lowermost surface and the bottom surface of the lower panel lie substantially in a plane.

Other aspects of the invention will be appreciated by reference to the detailed description of the preferred embodiment and to the claims that follow.

BRIEF DESCRIPTION OF THE DRAWINGS

The invention will be described by reference to the detailed description of the preferred embodiment and to the drawings in which.

DETAILED DESCRIPTION OF THE PREFERRED EMBODIMENT

Figure 6:
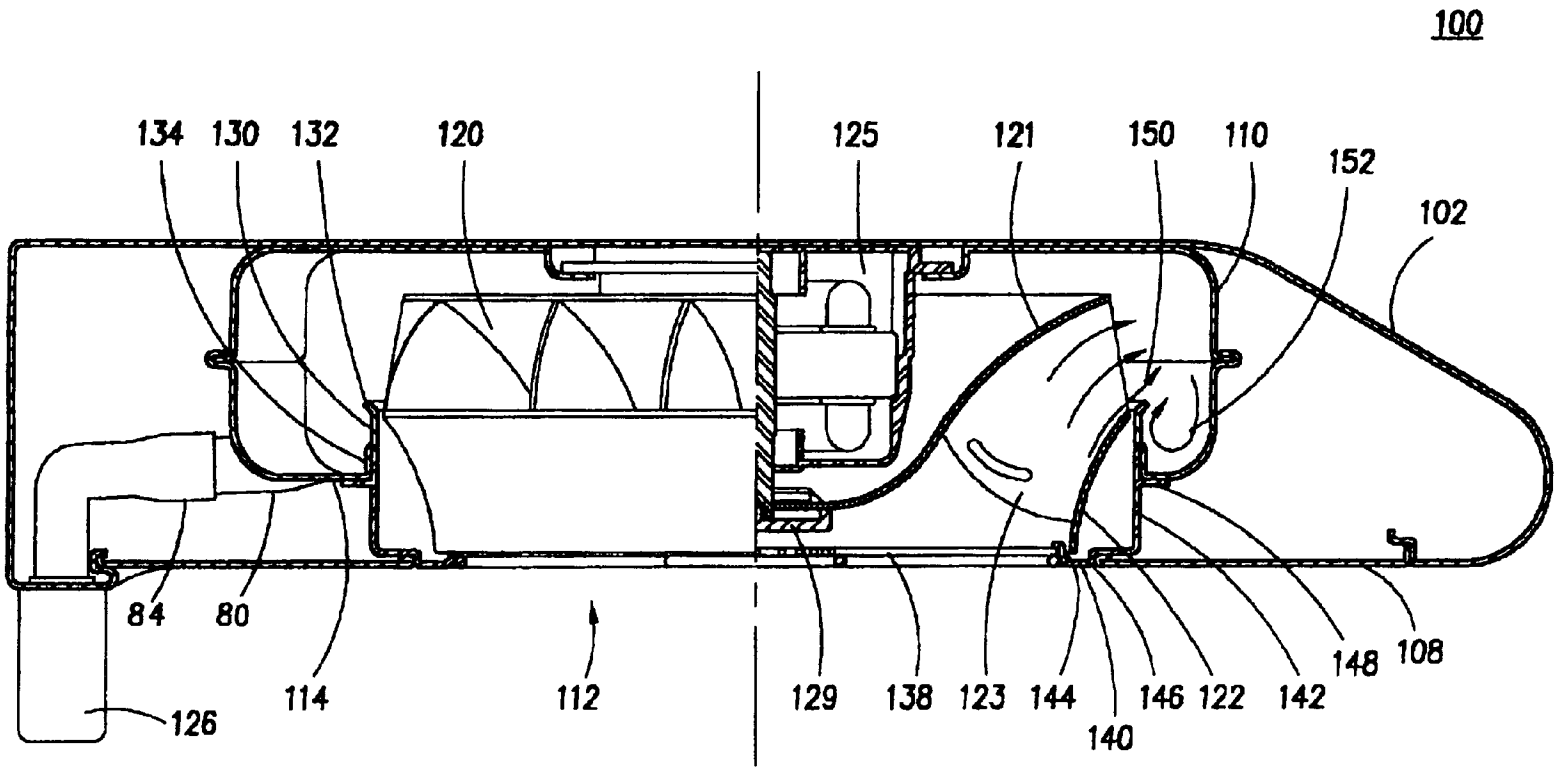
FIG. 6 is a cross sectional view of a range hood according to the preferred embodiment of the invention.

The preferred embodiment of a range hood 100 with a motor housing and fan connection according to the invention is illustrated in FIG. 6. The motor housing 110 itself doubles as a grease catcher. Tray 140, which has a fan grill 138 (shown best in FIG. 8) attached to it, is releasably connectable to the motor housing 110. Lower panel 108 of the hood body 102 abuts the tray 140 as discussed below. The housing 110, tray 140 and fan connection will be described in greater detail below.

Figure 4:
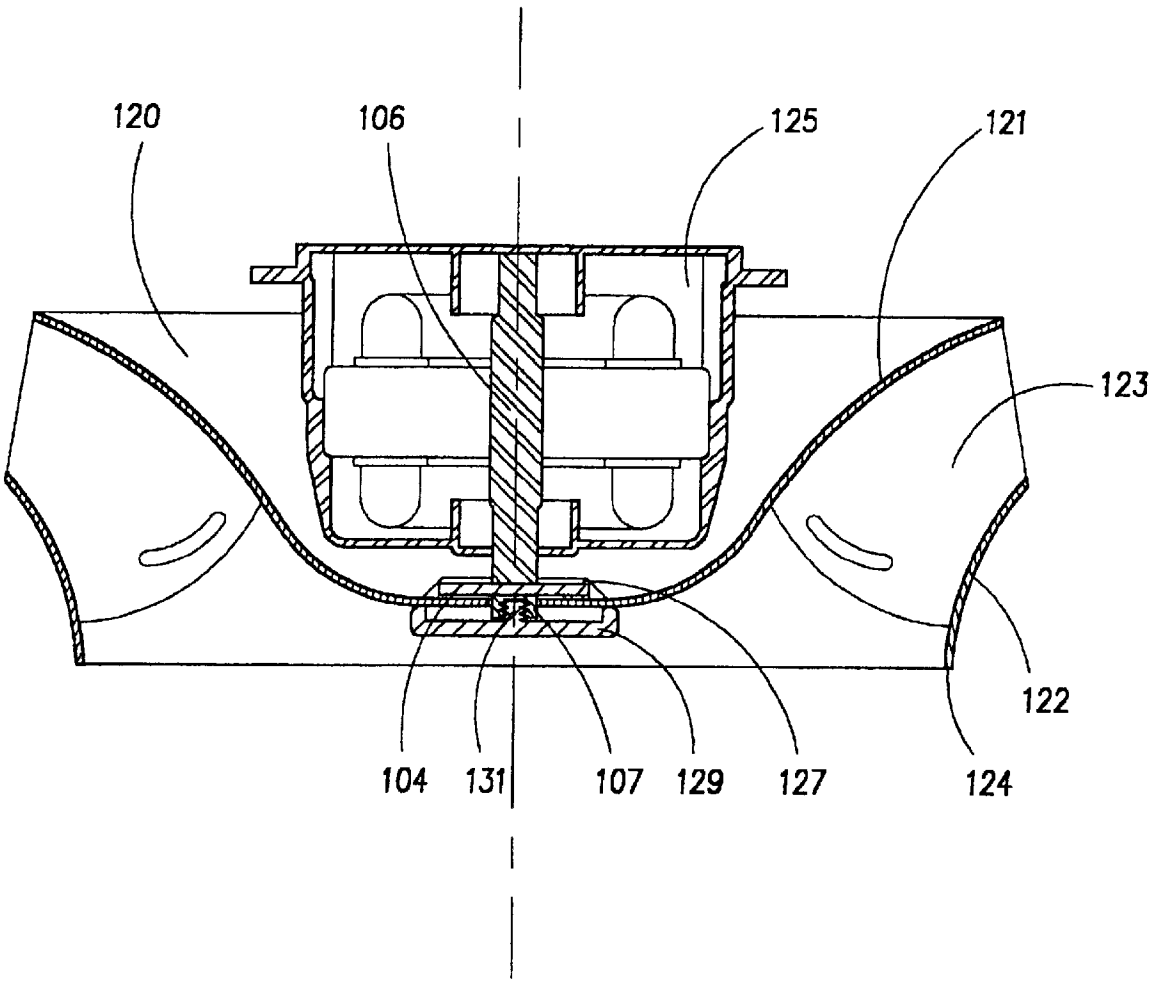
FIG. 4 is a cross sectional view of a motor, fan and fan cap according to the preferred embodiment of the invention.
Figure 5:
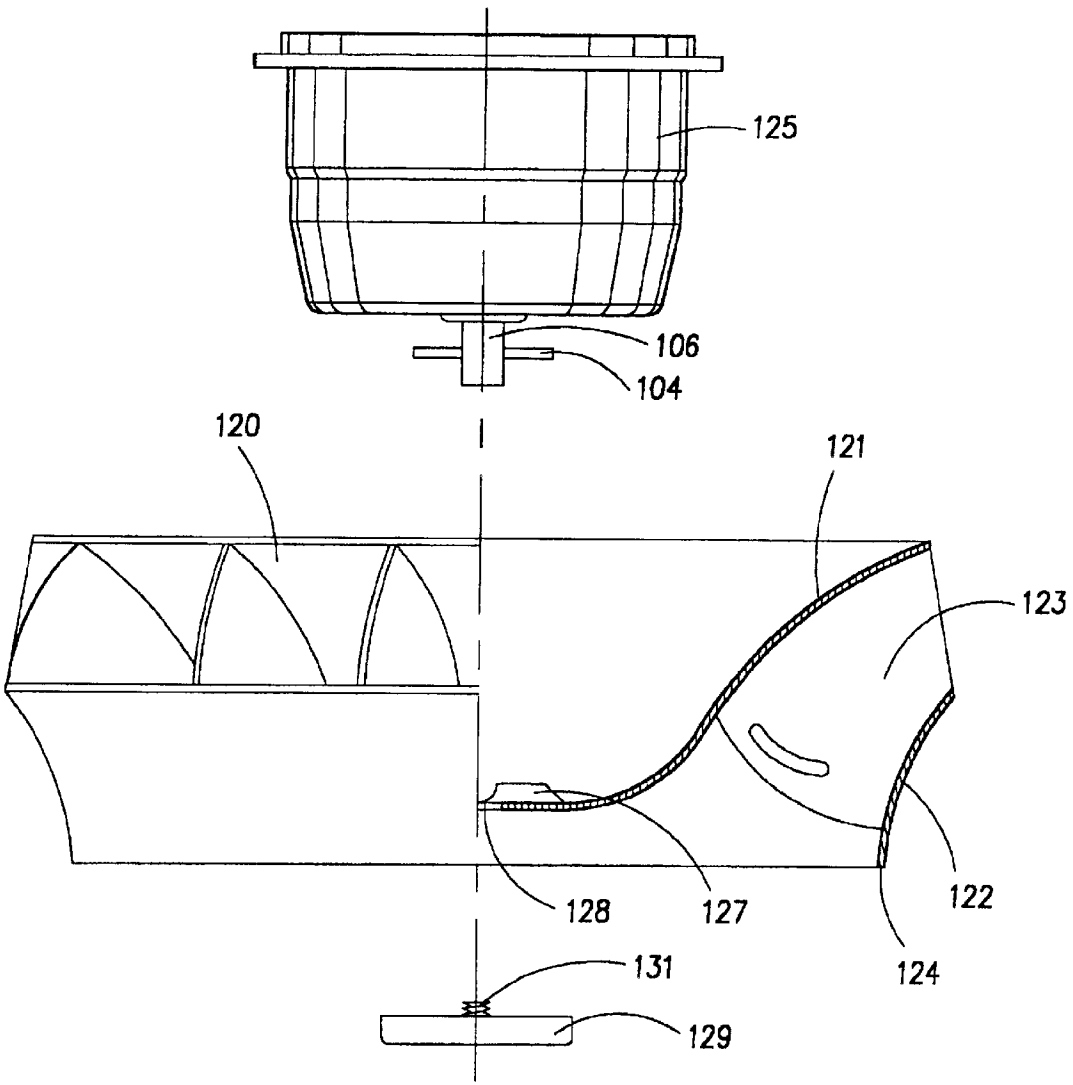
FIG. 5 is an exploded view of the motor, fan and fan cap shown in FIG. 4, with the right half of the fan shown in cross section.

The housing 110 defines an enclosure and is mountable within the enclosure formed by the hood body 102. The housing enclosure forms a pair of substantially similar chambers, only one of which is visible in the view provided in FIG. 6. For simplicity, the contents of only one of the chambers will be described. A motor 125 is mounted within the motor housing 110. Fan 120 is attached to the motor 125 and secured by fan cap 129. This is illustrated best in FIGS. 4 and 5. The motor 125 has a shaft 106 having a threaded recess 107. A torsional member 104 passes through shaft 106 just above the termination point of the threaded recess 107. The fan 120 has torsional member receiving portion 127 projecting from its upper surface 121 within which the torsional member may be seated. A plurality of fan blades 123 are radially spaced along and connected between upper surface 121 and lower fan surface 122. The fan 120 also has an aperture 128 through which shaft 106 may pass when the fan 120 is attached to the motor 125 (see FIGS. 4 and 5). The shaft 106 is dimensioned so as to extend just below the level of the radially inward portion of upper fan surface 121 when the motor and fan are connected. Fan cap 129 has an integral threaded bolt 131 that is dimensioned to engage with the threaded recess 107 and when so engaged acts to securely connect the fan and motor. Once secured, the fan cap remains above the level of, or approximately level with, lower fan edge 124 thereby allowing the use of a flat fan grill.

Figure 8:
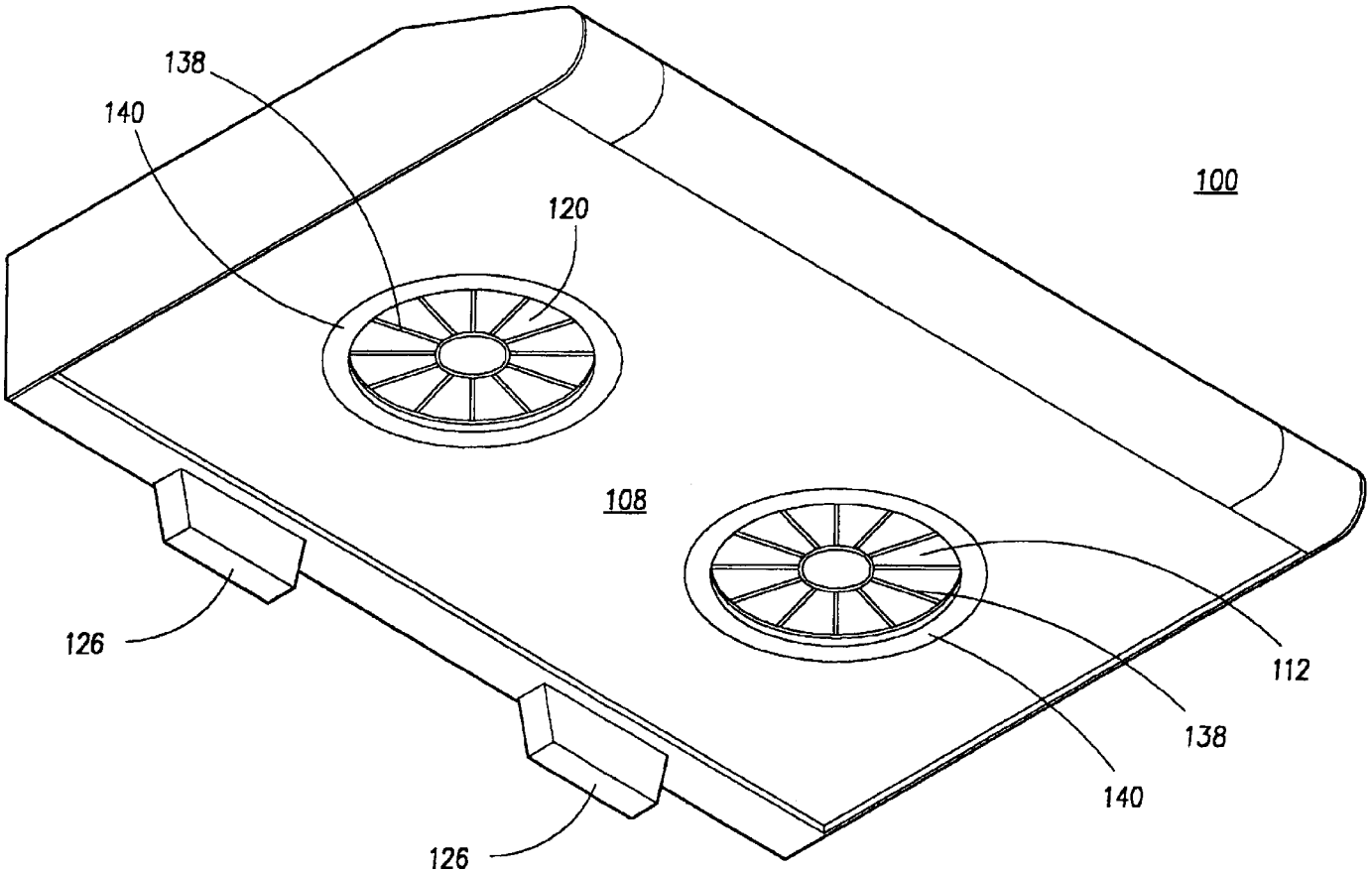
FIG. 8 is a perspective view of the range hood body, tray and fan grill shown in FIG. 6.

Fan grills 138, shown best in FIG. 8, are preferably flat and made of metal and are designed to allow maximum airflow into motor housing 110, while still preventing solid objects such as kitchen utensils or body parts from penetrating through the grill to fans 120. Because the fan grills are flat, and are positioned horizontally, grease that collects on the grill surface does not pool in any one area and is less likely to form a drop that could fall to a surface below. This is different than the prior art grill 34, which took the form of an inverted cone, from the bottom of which grease would drip into the fan grill tray 36. No fan grill tray is needed with this new design. Instead, the grill may simply be wiped periodically in order to keep it clean. This also results in material and space savings, making the range hood less costly and more aesthetically pleasing to the eye.

As shown in FIG. 6, wall 130 depends and rises vertically from, and substantially perpendicular to, the lower surface 114 of the motor housing. The diameter of the opening in the motor housing 110 formed by wall 130 is larger than the maximum diameter of the fan 120. A radially outwardly projecting flange 132 depends from wall 130 at an angle. Preferably the flange 132 is at an angle of 45 degrees to wall 130, however other angles are suitable, provided that the flange is above the level of a top edge of the bottom fan surface 122 so that it is positioned in the path of air being forced into the motor housing by fan 120. A portion of the air travelling immediately adjacent the bottom fan surface 122 is deflected by flange 132 as indicated by arrow 150. Turbulent air, indicated by arrow 152, that is circulating in the lower part of the motor housing is prevented from passing back between the fan and wall 130 into tray 140 where it could then reenter the fan as occurred with the range hood 10 of the prior art. Flange 132 acts to deflect the turbulent air 152 radially outward. In addition, any of the turbulent air travelling around the radially outer edge of the flange will come into contact with the deflected air 150 and will in turn be forced in that direction (radially outward). Preferably, wall 130 has a recessed portion 134 dimensioned for fitted engagement with tray 140. However, it is also contemplated that wall 130 could be linear or could have an inward and downwardly extending lip projecting therefrom, forming a gap with wall 130 within which tray 140 may be wedged.

The tray 140 is circular and has inner wall 144, concentric outer wall 142, floor 146 and fan grill 138, which is connected to inner wall 144. Inner wall 144 is proximate to, and defines, an intake opening 112. Outer wall 142 is distal from the opening in relation to the inner wall 144. Outer wall 142 is shaped and dimensioned to fit within recessed portion 134 when tray 140 is connected with housing 110 so that a portion of outer wall 142 is in abutment with wall 130. The diameter of inner wall 144 is smaller than the diameter of lower fan edge 124. The tray 140 is dimensioned such that when connected with the motor housing 140, the top of inner wall 144 is just above the level of lower fan edge 124, thereby directing air through intake opening 112 into the housing 110 by way of the fan 120. A clip or other form of suitable restraint (not shown) accessible on the outside surface of the motor housing may be used in conjunction with radial edge 148 in order to hold the tray in place.

Figure 1:
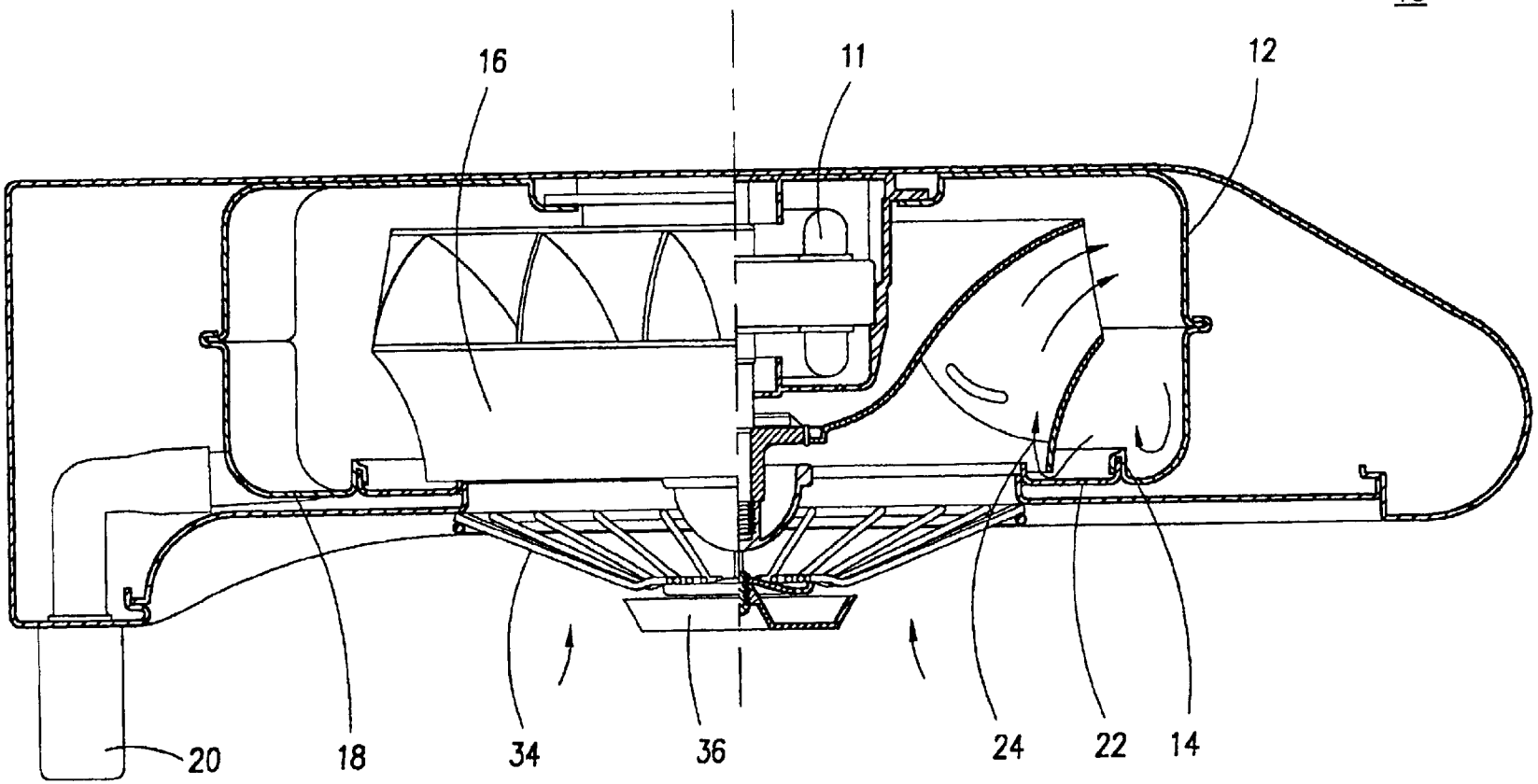
FIG. 1 PRIOR ART
FIG. 1 is a cross sectional view of a range hood according to the prior art.
Figure 2:
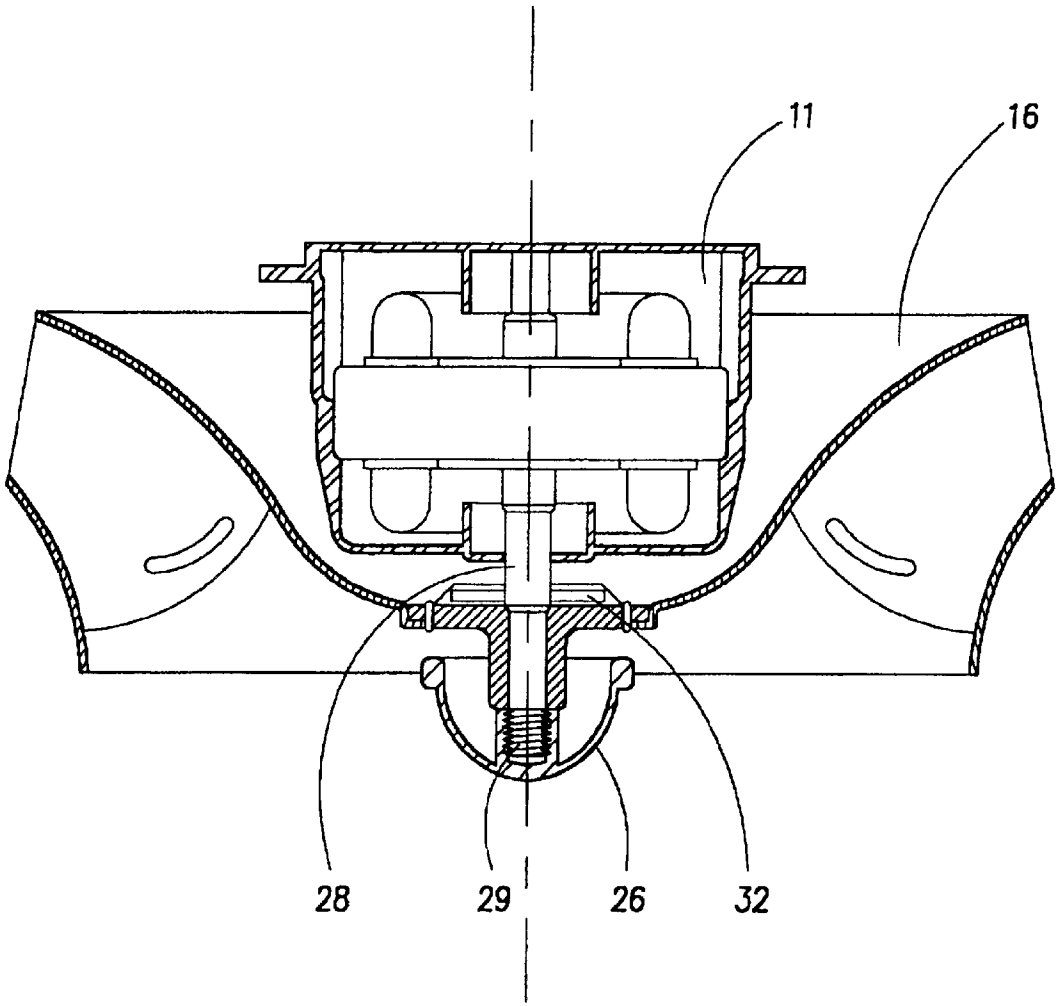
FIG. 2 PRIOR ART
FIG. 2 is a cross sectional view of the motor, fan and fan cap shown in FIG. 1.
Figure 3:
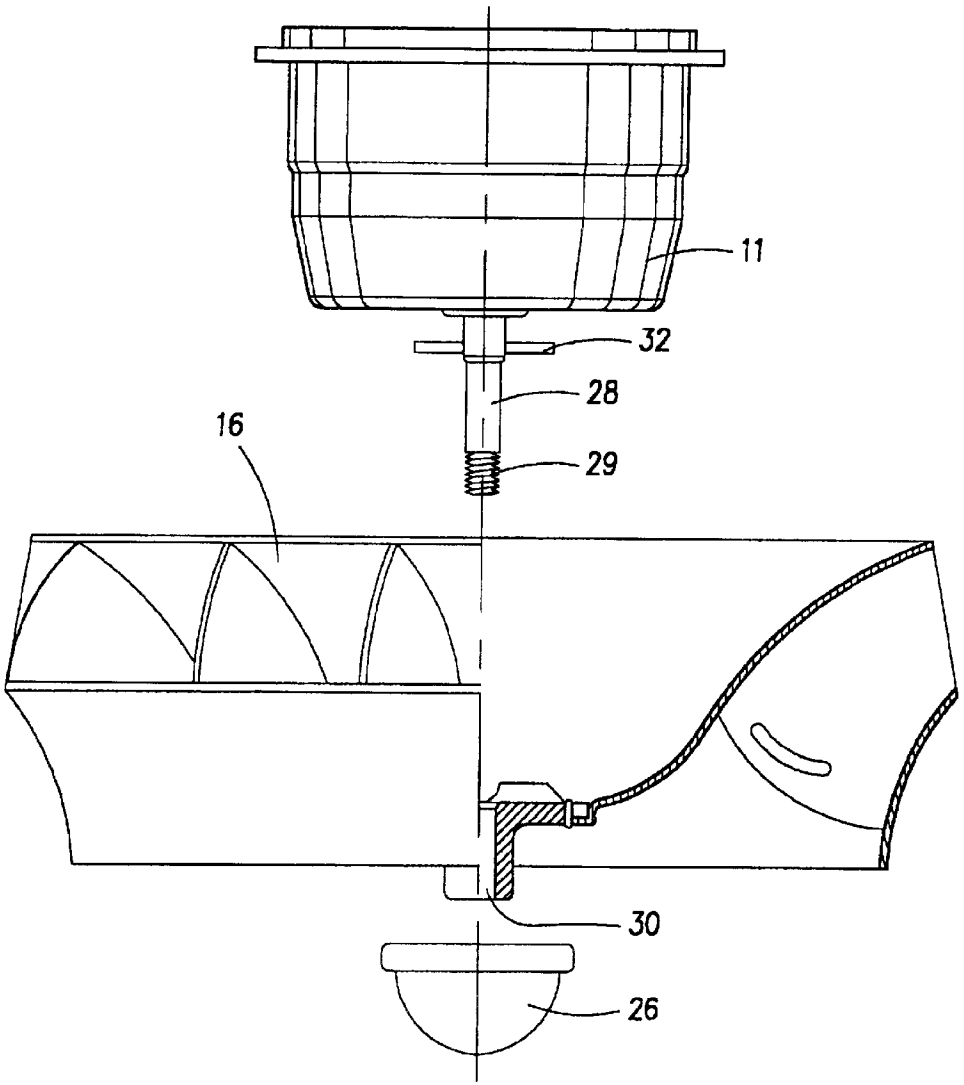
FIG. 3 PRIOR ART
FIG. 3 is an exploded view of the motor, fan and fan cap shown in FIG. 2, with the right half of the fan shown in cross section.

The lower panel 108 is removable from the remainder of main hood body 102. Lower panel 108 has a pair of openings corresponding to trays 140. When connected to the remainder of the hood body 102, the lower panel is in abutment with trays 140. Preferably, floor 146 is a stepped surface with a step rising from the inner to outer walls 144, 142. The stepped surface forms a notch against which lower panel 108 may be fitted in flush engagement with the tray 140 as shown in FIG. 6. In this way, the bottom of tray 140 and the bottom of lower panel 108 are located substantially in the same plane. The size of the range hood may therefore be reduced by the amount of space in the prior art range hoods between the lower panel and the bottom of the tray (see FIG. 1).

Preferably, the motor housing is of reduced size such that only a portion of fan 120 is positioned inside the housing 110 as shown in FIG. 6. When activated, motor 125 rotates fan 120, which draws air through intake opening 112 and into motor housing 110. Air drawn into the motor housing is then forced out of ventilation holes (not shown) in the upper surfaces of the housing 110 and hood body 102. The reduction in size of the motor housing results in an increased air pressure within the motor housing when the range hood is operating. Without wall 130 and flange 132 a great deal of the air forced into the motor housing would escape as was the case with the prior art. The wall and flange thereby increase the suction power and efficiency of the range hood.

Motor housing 110 is shaped such that any accumulated grease or liquid that condenses on its inner surface is directed towards a drain hole 80. Accumulated grease and liquids travel through hoses 84 by way of gravity to an external grease cup 126. Wall 130 acts as a barrier to any condensed grease or other liquid that accumulates in the interior of the motor housing. Typically only a very small amount of grease drips from a fan 120 as most is dispersed by means of the centripetal force of the rotating fan. Any grease or liquid that does drip from the fan when it is no longer rotating tends to drip from lower fan edge 122 and is captured in tray 140. As very little grease accumulates in tray 140, it need only be cleaned periodically during regular maintenance of the range hood and need only have minimal depth.

Figure 7:
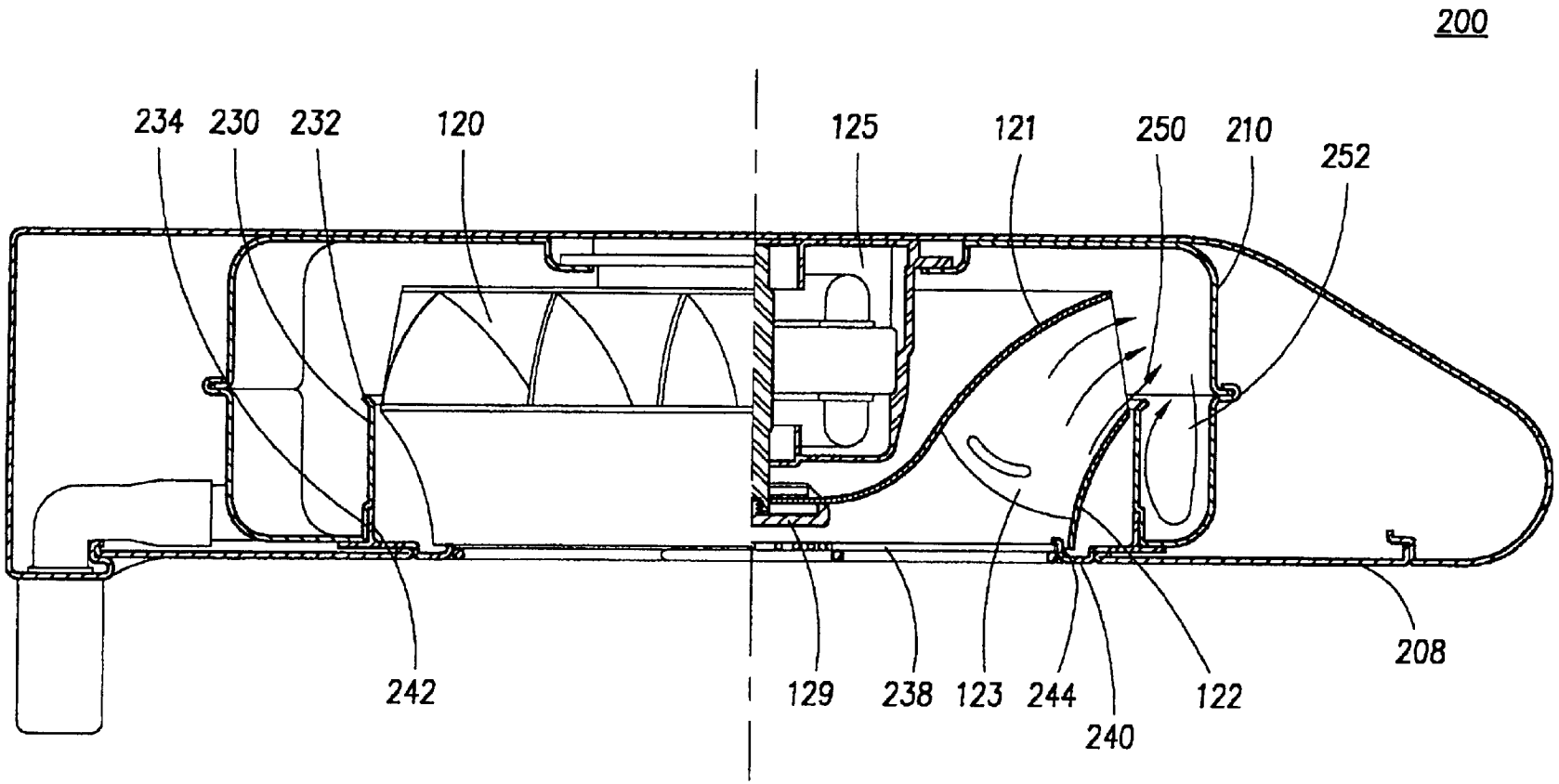
FIG. 7 is a cross sectional view of an alternative embodiment of a range hood.

An alternative embodiment of the invention is shown in FIG. 7. Those aspects of the alternative embodiment that are identical to aspects of the preferred embodiment have identical reference numbers. As illustrated with the alternative embodiment the motor housing 210 in range hood 200 may also be sized so that fan 120 fits within its enclosure. In this embodiment, outer wall 242 of tray 240 is sized to fit within depression 234 in circular wall 230. Circular wall 230 is of sufficient height such that flange 232 is positioned adjacent the entry point of air into the motor housing. Fan grill 238 is attached to inner tray wall 244. The lower panel 208 and the tray 240 abut one another and the bottom surfaces of each lie substantially in the same plane.

The main difference between the preferred and alternative embodiments shown in FIGS. 6 and 7 is in the sizing of the motor housings and trays. This is simply illustrative of the changes that may be made to aspects of the range hood while using the wall and flange. It is also contemplated that different fan types could be used. The fan connection system of the invention may also be used in association with the range hoods of the prior art.

By minimizing the space located between connecting parts, specifically the lower panel and tray, and by having a flat grill, the overall size of the range hood may be reduced. This more streamlined range hood is able to intake the same cubic feet per minute (cfm) of air of a larger range hood while taking up less space. Additionally, a smaller size translates into lower material costs in the construction of the range hood and additional savings in shipping and storing costs.

It will be appreciated by those skilled in the art that the preferred and alternative embodiments have been described in some detail but that certain modifications may be practiced without departing from the principles of the invention.

What is claimed is:

1. A range hood for drawing air from below the range hood and venting it to another location comprising:

a motor housing generally defining an enclosure and comprising an upper surface and a lower surface, said lower surface having at least one opening and at least one drain hole;

a motor having a rotatable shaft with a torsional member, said motor mounted within said enclosure;

a fan having a top fan surface and a bottom fan surface and a plurality of fan blades connected therebetween, said bottom fan surface having top and bottom edges, said fan being releasably connectable to said motor;

a tray comprising an air intake opening, first and second tray walls extending around said intake opening, and a floor between said first and second tray walls, said tray being releasably connectable to said motor housing opening; and wherein said motor housing opening is defined by a wall depending from said lower surface and projecting into the interior of said enclosure, said wall having an angular flange depending from said wall radially outwardly from said motor housing opening.

2. The range hood of claim 1 wherein a portion of said angular flange is located above the level of said top edge of said bottom fan surface such that when said fan draws air into said motor housing, a portion of air travelling immediately adjacent said bottom fan surface is deflected by said flange.

3. The range hood of claim 2 wherein said shaft has a threaded recess, said fan has an aperture through which said shaft way be inserted and wherein a fan cap having a threaded bolt is threadingly engaged with said threaded recess of said shaft.

4. The range hood of claim 3 further comprising a flat fan grill connected to said first tray wall and wherein when said fan is connected to said motor by said fan cap, said fan cap is above the level of a portion of said bottom fan surface.

5. The range hood of claim 2 wherein said motor housing is sized such that only a portion of said fan is located within said motor housing.

6. The range hood of claim 5 wherein said floor of said tray having a notch and a lowermost surface.

7. The range hood of claim 6 further comprising a range hood body having a releasably connectable lower panel, said lower panel having a bottom surface and an opening corresponding to said tray, wherein when said lower surface is connected to said range hood body, said lower panel and said tray are in abutment and said lowermost surface and said bottom surface of said lower panel lie substantially in a plane.

8. A range hood for drawing air from below the range hood and venting it to another location comprising:

a motor housing generally defining an enclosure and comprising an upper surface and a lower surface, said lower surface having at least one opening and at least one drain hole;

a motor having a rotatable shaft with a torsional member, said motor mounted within said enclosure, said shaft having a threaded recess;

a fan having a top fan surface and a bottom fan surface and a plurality of fan blades connected therebetween said bottom fan surface having top and bottom edges, said fan being releasably connectable to said motor and having an aperture through which said shaft may be inserted;

a fan cap having a threaded bolt fitted to be threadingly engaged with said threaded recess of said shaft, and wherein:

when said fan is connected to said motor by said fan cap, said fan cap is above the level of said bottom edge of said bottom fan surface.

9. The range hood of claim 8 further comprising a flat fan grill.

* * * * *